United States Patent [19]

Brugman

[11] 3,950,909

[45] Apr. 20, 1976

[54] SCREEN CEILING

[75] Inventor: Johannes Antonius Henricus Brugman, Rotterdam, Netherlands

[73] Assignee: Hunter Douglas International N.V., Willemstad, Netherlands Antilles

[22] Filed: Apr. 10, 1974

[21] Appl. No.: 459,805

[30] Foreign Application Priority Data

Apr. 13, 1973 Netherlands ..... 7305185

[52] U.S. Cl. ..... 52/483; 52/484; 52/665; 403/173; 403/374

[51] Int. Cl.[2] ..... E04B 5/52; E06B 3/54

[58] Field of Search ..... 52/484, 483, 507, 508, 52/509, 758 A, 280, 665, 660, 664; 403/170, 173, 174, 175, 374 X

[56] References Cited

UNITED STATES PATENTS

| | | | |
|---|---|---|---|
| 985,800 | 3/1911 | Hartbauer | 52/403 X |
| 2,577,119 | 12/1951 | Fitzgerald | 52/758 A |
| 2,659,807 | 11/1953 | Wakefield | 52/484 X |
| 2,725,126 | 11/1955 | Ely | 52/484 X |
| 2,750,014 | 6/1956 | Gordon | 403/173 X |
| 2,840,200 | 6/1958 | Wong | 52/758 A |
| 2,854,103 | 9/1958 | Kruger | 403/170 X |
| 3,014,564 | 12/1961 | Thomsen et al. | 52/484 X |
| 3,097,730 | 7/1963 | Halle | 403/173 |
| 3,248,840 | 5/1966 | Petterson | 52/758 D X |
| 3,388,517 | 6/1968 | Wohl et al. | 52/403 |
| 3,703,307 | 11/1972 | Curtis | 52/665 X |
| 3,705,470 | 12/1972 | Kent | 52/400 |
| 3,722,161 | 3/1973 | Brown | 52/400 |
| 3,797,192 | 3/1974 | DeJonge | 52/484 X |
| 3,837,130 | 9/1974 | Hildebrandt et al. | 52/403 |

FOREIGN PATENTS OR APPLICATIONS

| | | | |
|---|---|---|---|
| 1,163,532 | 9/1969 | United Kingdom | 403/374 |
| 1,279,492 | 10/1968 | Germany | 52/400 |
| 93,564 | 12/1896 | Germany | 403/173 |
| 24,087 | 12/1915 | United Kingdom | 403/173 |

*Primary Examiner*—Ernest R. Purser
*Assistant Examiner*—Leslie A. Braun
*Attorney, Agent, or Firm*—Pennie & Edmonds

[57] ABSTRACT

A screen ceiling is disclosed comprising a plurality of elongated panels arranged generally in vertical planes with adjacent ends of panels secured to supporting gusset joints in turn suspended from an overhead fixed support structure. Each gusset joint has an outwardly extending support for each panel connected thereto. The outwardly projecting supports in turn have projections extending through one or more openings in the panels which openings are adjacent the ends thereof. Joining and locking members cooperate with the projections extending through the panel openings to lock the panel ends to the gusset joints and prevent loosening.

16 Claims, 10 Drawing Figures

SCREEN CEILING

BRIEF DESCRIPTION OF THE INVENTION

The invention relates to a screen ceiling in which a plurality of panels arranged in generally vertical planes are supported at their adjacent ends by a gusset joint. The panels may be of any length and may be either, straight, curved or shaped in any of numerous ways provided they have at least one opening adjacent their ends for securement to the gusset joints. The openings may be formed by a simple punching operation or by drilling, cutting or other means. The panels may be of such light weight materials as aluminum, other sheet metals or synthetic materials such as plastic. The gusset joints may be made by extrusion of aluminum, other metals or synthetic plastic materials. The assembly of the panels and joints requires a minimum number of pieces and a minimum amount of tools.

DETAILED DESCRIPTION OF THE INVENTION

Figure 9:
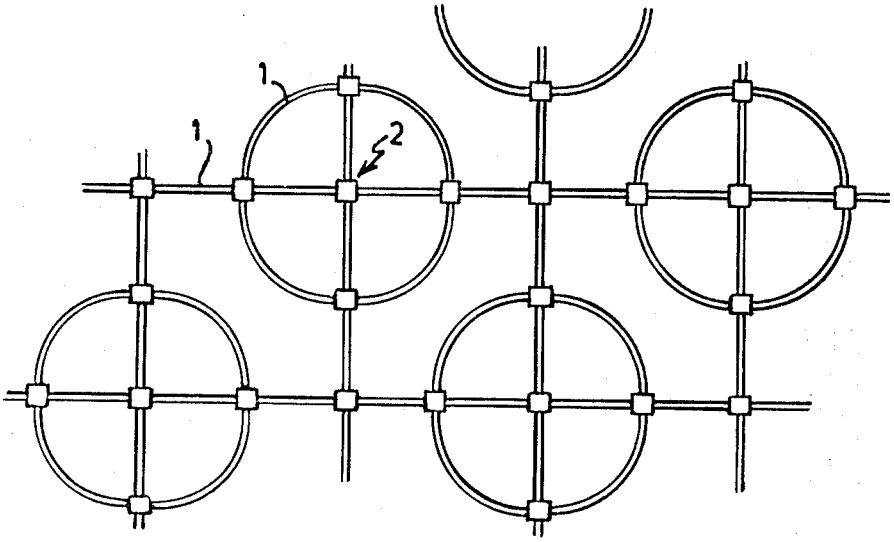
FIGS. 9 and 10 show two different mounting patterns for the screen ceiling.
Figure 10:
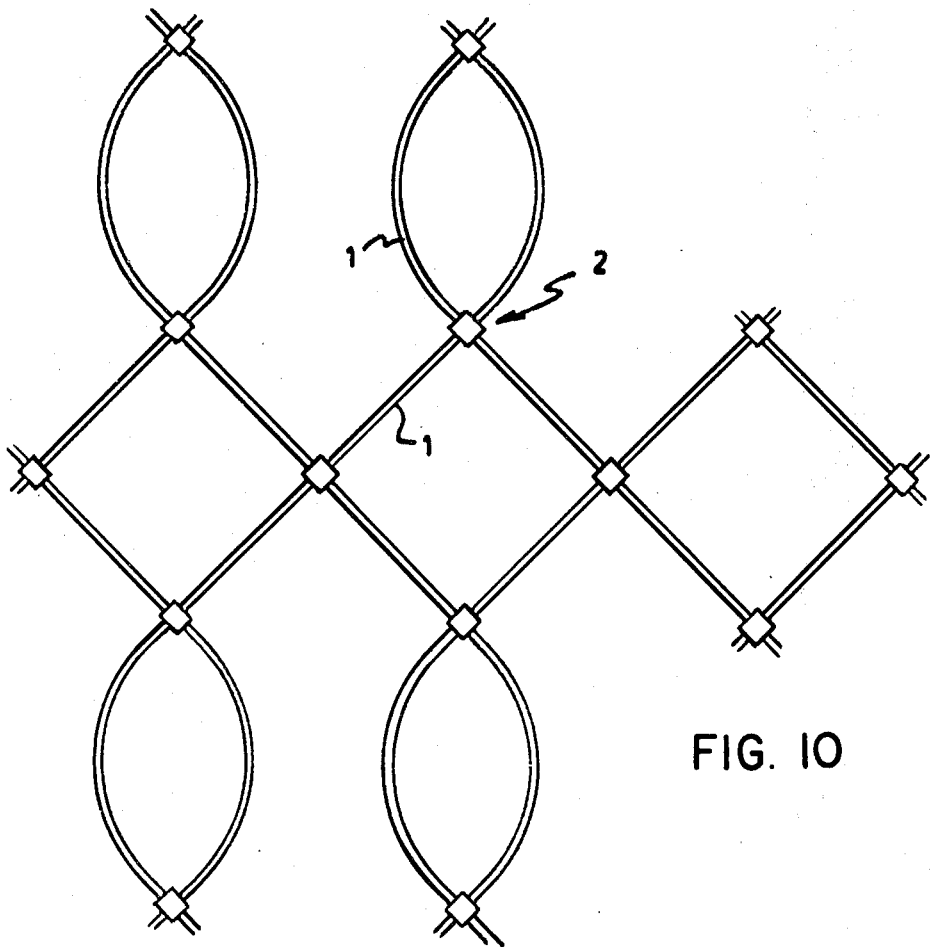

As shown in FIGS. 9 and 10, the screen ceiling of this invention when completed may have a variety of patterns depending upon the shape of the panels 1, and the selected pattern in which such panels are assembled. In FIG. 9 some of the panels 1 are relatively straight and others are curved. In FIG. 10 certain panels 1 are straight and other panels 1 are curved but are of a different radius than the curved panels 1 of FIG. 9. In all instances the ends of the panels 1 are connected to and supported by a gusset joint 2, as will be more fully understood from the following description other patterns than those shown in FIGS. 9 and 10 may be provided.

Figure 1:
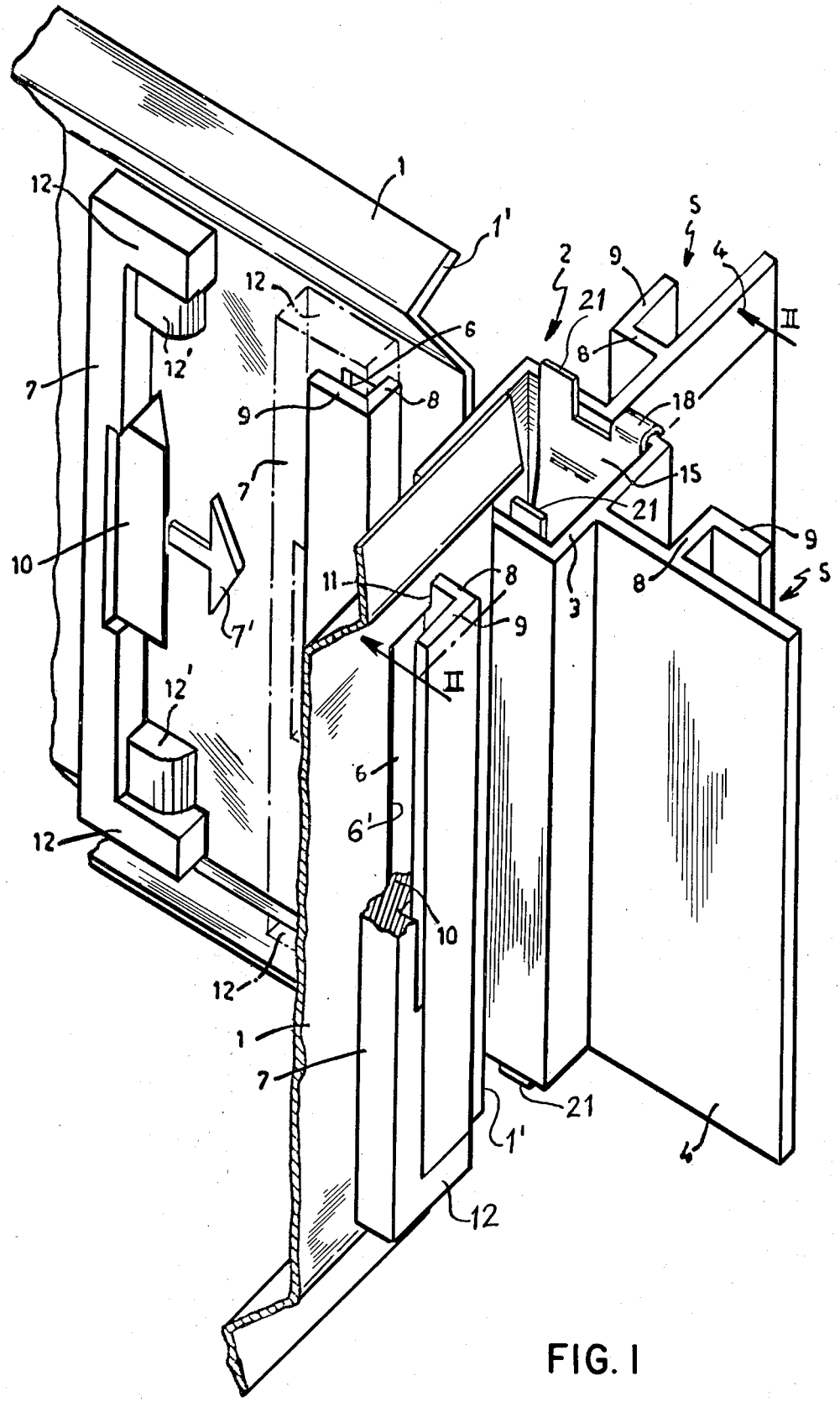
FIG. 1 shows a gusset joint in prospective with the adjacent ends of two panels mounted thereto.

With reference to FIG. 1, the gusset joint 2 is shown, as having a substantially rectangular shape with external walls 3 forming the central open ended tubular portion of the joint. Extending outwardly from the vertical walls 3 are generally planar support members 4 which are preferrably integral with the walls 3 having been extruded therewith.

Extending laterally from the supports 4 are "L" shaped members 5 comprised of legs 8 and 9. While supports 4 are shown as being arranged at 90° with respect to the walls 3, it will be appreciated that other angular arrangements of the supports 4 with respect to the walls 3 are possible to provide a variety of patterns to the finished screen ceiling. Also, while FIG. 1 shows the joints 2 as having four supports 4, it will be appreciated that this number is not fixed and that there need be only as many supports 4 as there are panels 1 to be supported by each gusset joint 2.

As shown in FIG. 1, panels 1 have elongated slots 6 therein adjacent the ends 1′ thereof.

During assembly the projection 5 including the legs 8 and 9 is passed through the slot 6 and the surface of the panel 1 rests against the adjacent surface of the support 4. To lock the panel 1 in place, a joining and locking member 7 is used which is shown in full lines in FIG. 1 on the left as it is about to be inserted into position. The member 7 is moved in the direction of the arrow 7′ during assembly so that the member 7 lays between the leg 9 and the adjacent surface of the panel 1.

Figure 4:
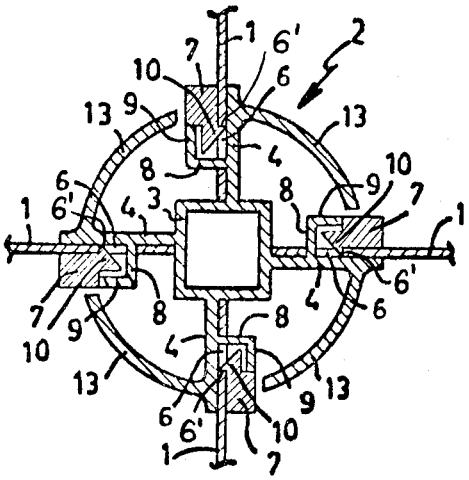
FIGS. 4 and 5 show cross-sectional views from above of two embodiments of the gusset joint of FIG. 1.
Figure 5:
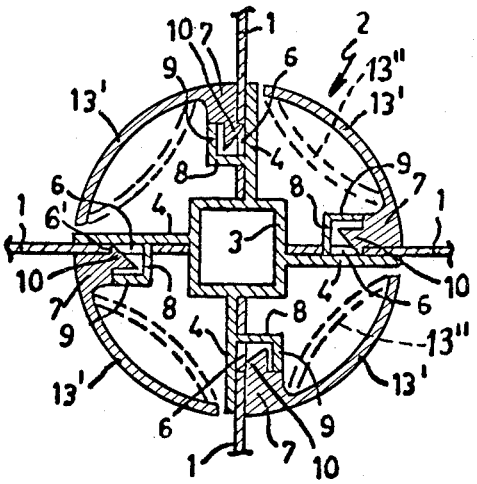

The joining and locking member 7 has terminal projections 12 at opposite ends thereof which bear against the opposite ends of the legs 8 and 9, as shown in dot-dash lines for one panel in FIG. 1, and as shown in solid lines (but, cut away) for the other panel 1, in FIG. 1. Thus vertical longitudinal movement of the member 7 is prevented by the integral projections 12. Members 12′ on the joining and locking member 7 serve to guide the member 7 into position and thus assists in the insertion of the joining and locking member 7. A locking lip or cam 10 engages behind the edge 6′ of the opening 6 as best shown in FIGS. 4 and 5. Thus the lip 10 prevents movement of the joining and locking member 7 in a direction opposite of the arrow 7′. The dimension of the legs 8 and 9 is such that they may readily pass through the slots 6. They may, for example, be almost as wide as the width of the slot 6 to pass therethrough. The dimension of the joining and locking piece 7 is such to be held firmly between the inner surface of the leg 9 and the facing surface of the panel 1, and to be snugly fit against the leg 8 when the lip 10 has engaged behind the edge 6′ of the slot 6. Thus the panel 1 is firmly held between the adjacent joining and locking member 7 and the support member 4.

The locking and joining member 7 is preferrably of a plastic material, and as such, there is sufficient flexibility with respect to the locking lip 10 to permit it to be snapped into place in engagement with the edge 6′.

Under certain circumstances, such as during a fire the member 7 may disintegrate and the panels 1 could possibly fall out; however, to prevent this possibility a narrow notch 11 is provided at the upper edge of the slot 6, which notch 11 embraces the upper edge of the leg 8. The parts are dimensioned so that when the projection 5 extends through the opening 6 and the joining and locking member 7 is in place the end 1′ of the panel 1 abutts against the wall 3 of the gusset joint thus also contributing to stability. That is to say that the wall 3 serves as a stop surface against which the edge 1′ of the panel 1 is engaged.

As shown in FIGS. 4 and 5 the bearing supports 4 extending outwardly from the walls 3 are offset slightly from the center of the walls 3 in such a manner that the panels 1 will be positioned in planes which pass through the axis of the central vertical tube of the gusset joint 2.

In order to give a more finished appearance to the gusset joint, a curved wall 13 is shown in FIG. 4, as extending laterally from the supports 4 in the opposite direction from the projections 5 toward the joining and locking member 7 of the adjacent support 4. Alternatively, as shown in FIG. 5, the arcuate wall 13′ may be incorporated as part of the joining and locking member 7 and extend in the opposite direction to close to the next adjacent support 4. While FIGS. 4 and 5 show these finishing walls as being convex, it will be appreciated that they could as well be concave as shown in dotted lines at 13'' in FIG. 5 or any other alternative shape desired since, as mentioned above, the purpose of these walls is to merely provide an attractive and finished appearance to the gusset joint 2.

Figure 6:
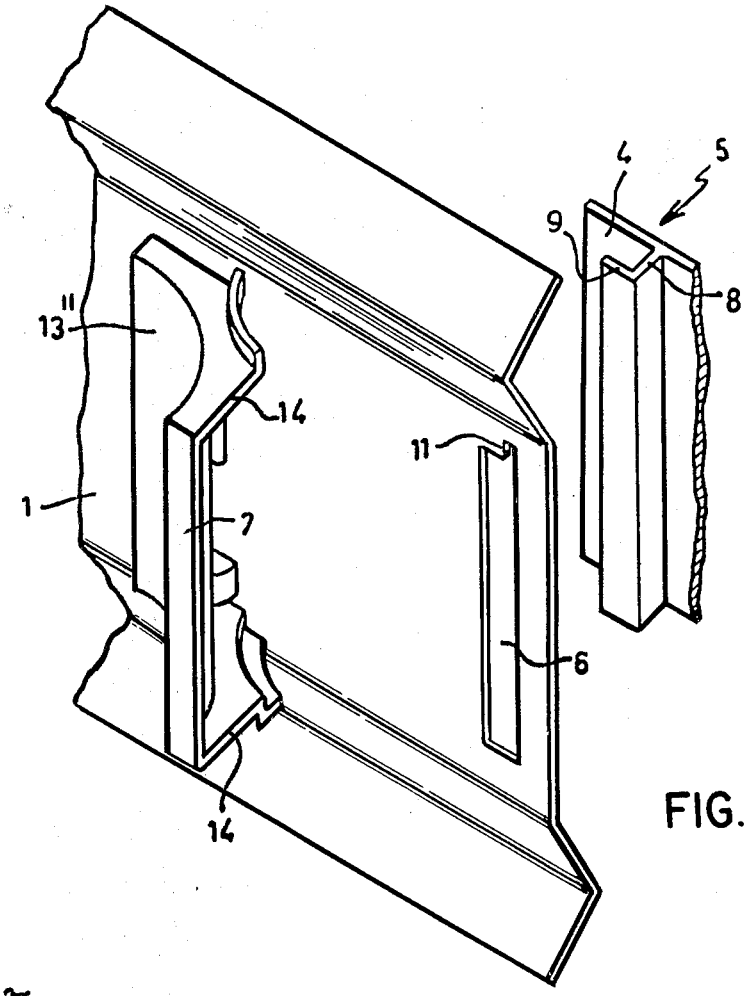
FIG. 6 shows a second embodiment of the joining and locking member.

As shown in FIG. 6, the locking and joining member 7 has the concave wall 13'' and additionally has opposite end walls 14 which further enhance the appearance of the finished gusset joint 2.

Figure 2:
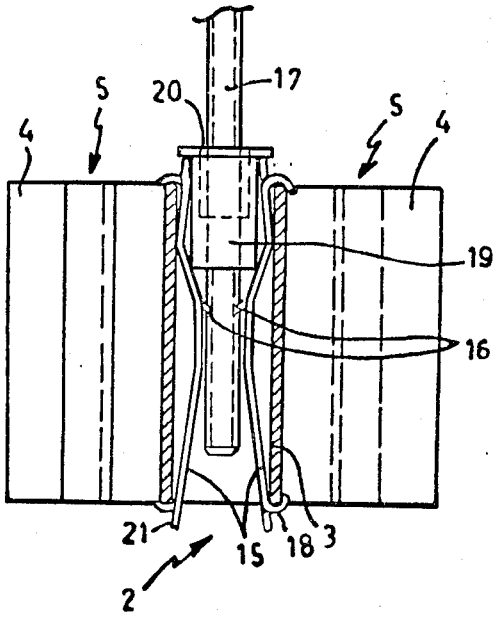
FIG. 2 is a cross-section along the line II—II of the gusset joint of FIG. 1 with the suspension device for the joint also shown therein.
Figure 3:
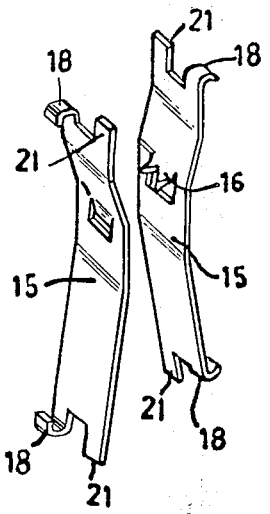
FIG. 3 shows a detail of the resilient clips of FIG. 2.

FIGS. 2 and 3 show how the gusset joint 2 is suspended from a fixed support (not shown) thereabove. This fixed support may be an overlying ceiling, concrete slab or the like as is well known in the art. Two spring clips 15 are provided having inwardly extending resilient tongues 16 facing each other within the tube defined by the walls 3. On the upper and lower ends of the spring clips 15 are curved lips 18 that engage about the upper and lower edges of the walls 3. It should be noted that the panel 1 abutts the wall 3 on one side of the support 4 and the lips 18 of the spring clips 15 engage the upper and lower edges of the wall 3 on the other side of the support 4. Thus, the lips 18 do not interfere with assembly or disassembly of the panels 1. A screw threaded rod 17 secured at its upper end to a suitable support structure (not shown) extends downwardly into engagement with the resilient tongues 16 and is threadly engaged therewith. The gusset joint 2 may therefore be adjusted in height along the rod 17 by relative rotation movement between the rod 17 and gusset joint 2. A sleeve 19 with an internal screw thread may also be threadly engaged with the rod 17 to guide the threaded rod 17 into engagement with the resilient tongues 16. A flange 20 on sleeve 19 will, upon completion of the assembly, rest upon the upwardly extending projections 21 of the spring clips 15.

Figure 7:
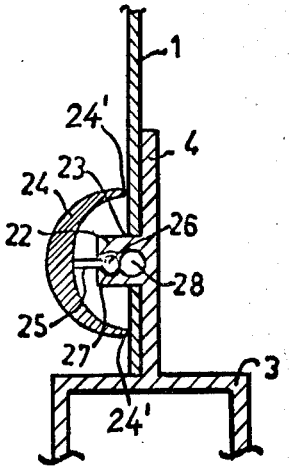
FIGS. 7 and 8 show two additional embodiments of gusset joints with portions of the joint of FIG. 7 being removed.
Figure 8:
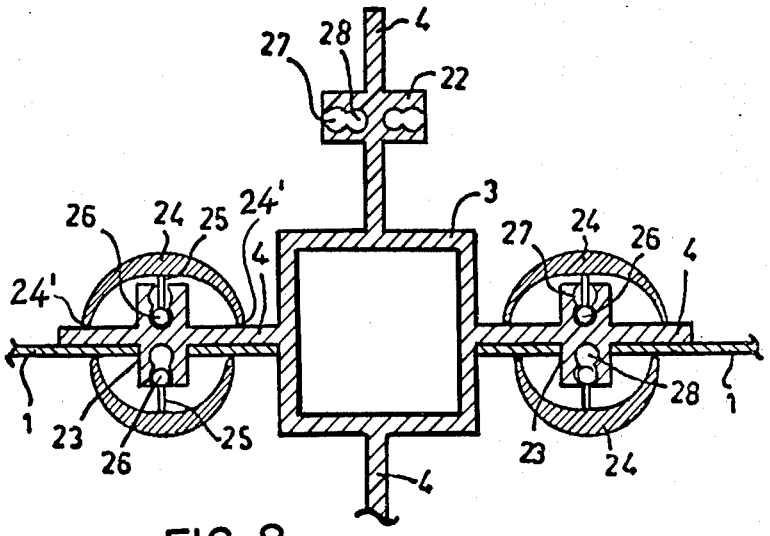

FIGS. 7 and 8 show modified embodiments of the locking projections 5. As shown in FIG. 7, the supporting plate 4 has projecting laterally therefrom a cylindrical pin 22 which passes through a cooperating opening 23 in the panel 1. To insure best securement of the panel to the support 4 there may be a plurality of cylindrical pins 22 extending through a plurality of openings 23 of similar shape in the panel 1. For example, two pins one above the other, may pass through two circular openings in the panels 1 to secure the same.

To complete securement of the panel 1 to the support 4 of the embodiment of FIG. 7, a joining and locking member 24 analogous to the joining and locking member 7 of the embodiment of FIG. 1 is utilized. The joining and locking member 24 has extending therefrom a central post 25 having an enlarged head 26. The cylindrical pin 22 has two vertical openings 27 and 28 bored or otherwise provided therein. The cap shaped joining and locking member 24 is preferrably of a resilient material such as plastic and the enlarged head 26 may be readily snapped into the opening 27 of the pin 22. By proper dimensioning of the joining and locking member 24, the edges 24' thereof will bear against the outer surface of the panel 1 holding it firmly against the support 4 when the head 26 is in place in the opening 27. If no panel 1 is to be used with a particular support 4 then, in that event, the head 26 is pressed inwardly still further until it is engaged in the opening 28 at which time the edges 24' will bear against the adjacent surface of the support 4 as best shown in FIG. 8 for the upper caps or locking members 24. As shown in FIG. 8, the supports 4 have cylindrical pins 22 extending from both sides of the support thus permitting the panels to be supported on either or both sides thereof and with the joining and locking members 24 being used either to lock a panel 1 in place as shown in FIG. 7 and the lower members 24 in FIG. 8, or used solely as a finishing cap to hide the cylindrical pins 22 as shown in FIG. 8 with respect to the upper caps 24.

The panels 1, as previously indicated may be straight, bent, curved, bowed, perforated or shaped in numerous ways, and they may have various dimensions with respect to length, width and thickness. The panels 1 as shown in FIGS. 1 through 8 are straight and have oppositely directed generally "V" shaped strips along their opposite longitudinal edges. The panels may be made of any one of numerous materials including several different metals, plastic and the like, with aluminum being presently preferred. The gusset joints 2 may be of any one of a wide variety of materials but are preferably extruded aluminum cut to length.

I claim:

1. A screen ceiling comprising a plurality of elongated panels, a plurality of gusset joints, each of said gusset joints having a central wall portion, each gusset joint having a panel support for each panel to be supported thereby, each of said panel supports being integral with and extending outwardly from the wall portion of its associated gusset joint, each of said panels having a portion adjacent an end thereof lying against a panel support, an opening in said portion of each of said panels and intermediate the length thereof that lies against said support, a projection integral with each of said supports and extending laterally of their associated support from intermediate the length thereof, each said projection extending through the opening of a panel lying against said associated support, a locking member for each of said openings, said locking members each being engaged with a projection on the opposite side of a panel from the panel's associated support and bearing against a face of said panel for securing said panel between said panel support and said locking member, each of said locking members having a locking element for positively locking said member in place other than solely by friction.

2. A screen ceiling comprising a plurality of elongated panels, a plurality of gusset joints, each of said gusset joints having a central wall portion, each gusset joint having a panel support for each panel to be supported thereby, each of said panel supports being integral with and extending outwardly from the wall portion of its associated gusset joint, each of said panels having a portion adjacent an end thereof lying against a panel support, an opening in said portion of each of said panels and intermediate the length thereof that lies against said support, a projection integral with each of said supports and extending laterally of their associated support from intermediate the length thereof, each of said projections extending through the opening of a panel lying against said associated support, a locking member for each of said openings, said locking members each being engaged between a projection and a face of a panel which face is opposite to that which lies against the panel's associated support and bearing against said face of said panel support and said locking member, each of said locking members having a locking element, and each of said locking elements being engaged in the opening of said panel and extending therethrough toward the associated support for said panel to prevent accidental dislodgement of said locking member from its position between said projection and said panel.

3. The screen ceiling of claim 2 in which each of said projections extending outwardly from said panel support through said panel openings comprises a first leg arranged at an angle to said panel support, said first leg being longer than the thickness of said panels, a second leg extending from said first leg at an angle thereto, and each of said locking members being snugly fit between said second leg and a panel lying against a panel support.

4. The screen ceiling of claim 3 in which each of said second legs is substantially parallel to its associated panel support.

5. The screen ceiling of claim 4 in which each of said first legs is substantially perpendicular to its associated panel support whereby said projections are generally "L" shaped.

6. The screen ceiling of claim 5 in which said gusset joints extend transversely to the length of said panels, said openings in said panels are elongated slots extending transversely of the length of said panels adjacent the ends thereof, and in which said projections are elongated in a direction transverse to the length of said panels and of a length to be received by said slots, and said "L" shape is the cross-sectional shape of said projections.

7. The screen ceiling of claim 6 in which each of said locking elements comprises a lip element in engagement with one longitudinal edge of said elongated slot.

8. The screen ceiling of claim 7 in which said locking members are sufficiently flexible for said lip elements to be snapped into place in engagement with said edges of said slots.

9. The screen ceiling of claim 6 in which the transverse ends of said panels adjacent said openings abutt the central wall portion of their associated gusset joint.

10. The screen ceiling of claim 9 in which said central wall portion of said gusset joints defines an elongated open ended tube, and in which the panel supports are offset with respect to the central axis of said tube by an amount sufficient to insure that the plane of the panels supported thereby passes through said axis.

11. The screen ceiling of claim 10 in which said tube is polygonal in cross-section and panels supported on opposite sides of said tube reside in the same plane.

12. The screen ceiling of claim 11 in which said panel supports are offset in the same direction about said tube.

13. The screen ceiling of claim 6 in which one end of each of said slots has a notch embracing the thickness of a said first leg.

14. The screen ceiling of claim 6 in which said locking member has terminal projections engaging the opposite ends of said "L" shaped projections.

15. The screen ceiling of claim 14 in which said locking member has a finishing plate extending therefrom toward the next panel support on the same gusset joint.

16. The screen ceiling of claim 14 in which said panel support has a finishing plate extending toward the next supported panel on the same gusset joint.

* * * * *